US007350895B2

(12) United States Patent
Tiedge

(10) Patent No.: US 7,350,895 B2
(45) Date of Patent: Apr. 1, 2008

(54) PRINTING CONTAINER FILL INDICATOR

(76) Inventor: John Tiedge, 20555 Tomball Pkwy., Houston, TX (US) 77070

( * ) Notice: Subject to any disclaimer, the term of this patent is extended or adjusted under 35 U.S.C. 154(b) by 415 days.

(21) Appl. No.: 11/111,108

(22) Filed: Apr. 20, 2005

(65) Prior Publication Data

US 2006/0238580 A1 Oct. 26, 2006

(51) Int. Cl.
*B41J 29/393* (2006.01)
*B41J 2/175* (2006.01)

(52) U.S. Cl. ..... 347/19; 347/85

(58) Field of Classification Search ..... 347/7, 347/19, 86, 87, 85; 141/2, 18
See application file for complete search history.

(56) References Cited

U.S. PATENT DOCUMENTS 5,367,328 A * 11/1994 Erickson ..... 347/7
5,510,820 A 4/1996 Aulick
5,526,099 A 6/1996 Katakabe et al.
5,847,735 A 12/1998 Betschon
6,007,173 A * 12/1999 DeLouise et al. ..... 347/7
6,099,101 A 8/2000 Maurelli et al.
6,172,695 B1 1/2001 Liu
6,247,803 B1 6/2001 Kanaya
6,260,942 B1 7/2001 Ahne
6,390,614 B2 5/2002 Urlaub
6,416,152 B1 * 7/2002 Matsuzaki et al. ..... 347/19
6,682,184 B2 1/2004 Anderson
6,685,290 B1 * 2/2004 Farr et al. ..... 347/7
6,808,245 B2 * 10/2004 Katayama ..... 347/19
7,040,729 B2 * 5/2006 Richards ..... 347/7

FOREIGN PATENT DOCUMENTS

EP 0694404 1/1996
EP 0 803 365 4/1997

OTHER PUBLICATIONS

International Search Report for Application No. PCT/US2006/012923. Report issued Aug. 24, 2006.

* cited by examiner

*Primary Examiner*—Anh T. N. Vo

(57) ABSTRACT

Methods and apparatuses are provided for use with printing devices. One apparatus includes a housing forming a reservoir that is suitable for holding a printing material therein, and having an outlet feature configured to allow the printing material to be withdrawn from the reservoir and an inlet feature configured to allow an amount of printing material to be deposited within the reservoir, and a fill indicator operatively coupled to the housing. The fill indicator includes a breach mechanism that is configured to be detectibly altered when the inlet feature is used to deposit the amount of printing material into the reservoir, and an interface that is operatively coupled to the breach mechanism and configured to allow detection of at least one electrical characteristic of the breach mechanism.

34 Claims, 6 Drawing Sheets

PRINTING CONTAINER FILL INDICATOR

BACKGROUND

Printing devices typically have consumable printing material containers that need to be replaced from time to time as the printing material is consumed during printing. For example, inkjet printing devices typically require replacement of one or more ink cartridges or containers, whereas laser printing devices typically require replacement of one or more toner cartridges or containers.

In certain instances, it may be useful for the user of the printing device to know when a replacement container has been filled with printing material.

BRIEF DESCRIPTION OF THE DRAWINGS

The following detailed description refers to the accompanying figures.

DETAILED DESCRIPTION

Figure 1:
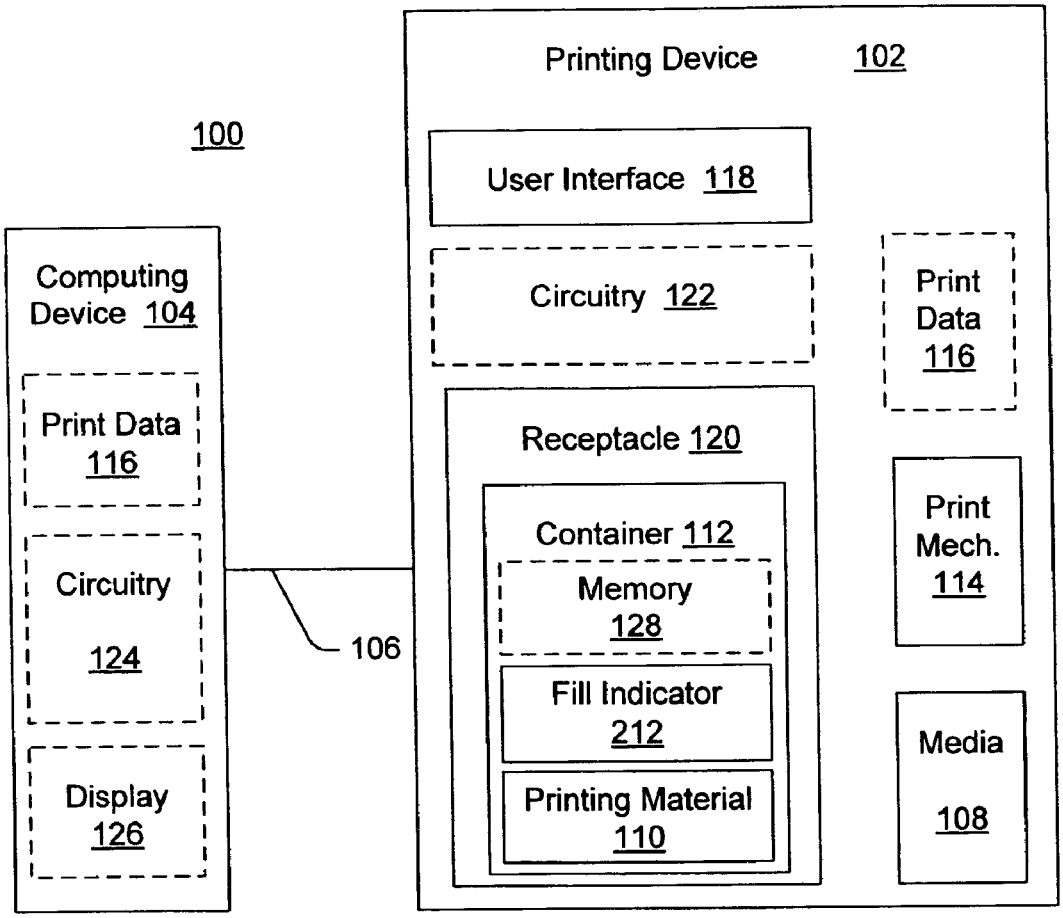
FIG. 1 is a block diagram depicting an exemplary printing environment having a container with a fill indicator, in accordance with certain embodiments of the present invention.

FIG. 1 is a block diagram depicting an exemplary printing environment 100 having a printing device 102 coupled to a computing device 104 through a communication link 106.

Printing device 102 is representative of any device capable of printing information on a media 108 using a consumable printing material 110. Examples of such printing devices include inkjet printers, laser printers, copiers, facsimile machines, and the like. Media 108 is representative of any material that can be printed to or on. Examples of media include paper, plastics, cloth, and the like. Consumable printing material 110 is representative of any material that can be used in printing information on media 108. By way of example, in certain exemplary implementations printing material 110 may include fluid materials such as inks, fixers, and the like. In other exemplary implementations, printing material 110 may include non-fluid materials such as toners and the like.

In this example, printing material 110 is provided in a container 112 that is inserted into or otherwise arranged for use by a print mechanism 114. Here, container 112 is operatively arranged within a receptacle 120 that is configured to receive container 112. Printing device 102 may have one or more containers 112, and/or one or more print mechanisms 114. Container 112 includes a fill indicator 212, which is described in greater detail below. In certain implementations, container 112 may also include memory 128 or some other device for recording information about container 112.

Print mechanism 114 is representative of any mechanism that selectively prints information to media 108 using printing material 110. Thus, for example, print mechanism 114 may include circuitry and other mechanisms that are configured as a printhead that selectively ejects droplets of fluid onto media 108 in response to print data 116. In other examples, print mechanism 114 may include circuitry and other mechanisms that are configured to selectively form and fuse toner particles onto media 108 in response to print data 116. Print data 116 may be locally generated by printing device 102 or remotely generated by computing device 104.

Printing device 102, in this example, also includes a user interface 118. User interface 118 may be configured to receive user inputs, for example, via an input key, a touch screen, a pointing device, or other like interface. User interface 118 may be configured to provide information or feedback to the user, for example, via graphical display mechanism, display screen, lighted features, audio mechanism, and the like.

Computing device 104 is representative of any device that is capable of interacting with printing device 102 in supporting a printing process and/or a servicing process. When supporting a printing process, for example, computing device 104 may provide print data 116 to printing device 102 through communication link 106. Computing device 104 may also receive information about the printing process, printing device, etc., from printing device 102 in support of a printing process.

Other information about printing device, etc., may be exchanged between computing device 104 and printing device 102 in support of a servicing process. By way of example, one servicing process may be the replacement of container 112. Here, information about the condition or status of a replacement container may be provided to computing device 104. Computing device 104 may then provide information or feedback to the user about the container's condition/status and/or perform some other function based on the information.

Computing device 104 may include, for example, a personal computer, a laptop computer, a handheld computer, a personal digital assistant device, a portable telephone device, a digital camera, a server device, or other like device/appliance. While illustrated as being separate in FIG. 1, in certain implementations computing device 104 and printing device 102 may be incorporated into a single device with communication link 106 being internal to the single device.

Communication link 106 is representative of any communication media and/or associated circuitry that supports the exchange of information in at least one direction between printing device 102 and computing device 104. Communication link 106, for example, may employ wired and/or wireless communication techniques. In certain implementations, communication link 106 may include a network, such as, a local area network, an intranet, the Internet, etc.

The term "circuitry" as used herein is meant to broadly representative of any form of hardware, firmware, software programmed instructions, and/or mixture thereof, and may include digital logic and/or analog components as needed to perform one or more desired functions. In certain implementations, "circuitry" may include a plurality of distributed circuits that are operatively coupled together.

As illustrated in FIG. 1, printing device 102 may include circuitry 122 that is configured to interface with container 112, and more particularly with fill indicator 212. For example, as described in greater detail below, in certain implementations circuitry 122 may be operatively coupled with fill indicator 212 and configured to determine if container 112 has been filled with printing material 110. If circuitry 122 determines that container 112 has been filled, then circuitry 122 may indicate such determination (or a lack of such determination) to the user through user interface 118, for example, by way of an indicator light, audio signal, displayed message, or the like.

Circuitry 122 may also (or alternatively) provide information to other circuitry indicative of such determination. For example, computing device 104 may include circuitry 124 that is operatively coupled to receive information from circuitry 122 through communication link 106. The information may already indicate such a fill determination, or may include unprocessed and/or partially processed information gathered from fill indicator 212. With this information, circuitry 124 may determine if container 112 has been filled with printing material 110. Once circuitry 124 has determined (or been provided with) such a fill determination, then circuitry 124 may indicate such determination or a lack of such determination to the user through a user interface such as a display 126, for example, by way of a displayed message. Hence, for example, one message may indicate that container 112 has been filled. Another message may indicate that container 112 has not been filled. Circuitry 122 may also provide information to memory 128, if present, indicative of such determination.

In certain implementations, circuitry 124 may be configured to operatively couple with fill indicator 212 using circuitry 122 to essentially complete the communications connection in concert with communications link 106.

In still other implementations, all or portions of circuitry 122 may be provided as part of container 112 and/or fill indicator 212. In other implementations, fill indicator 212 may include, be part of, or otherwise operatively coupled to onboard logic and/or memory circuitry of container 112.

Figure 2:
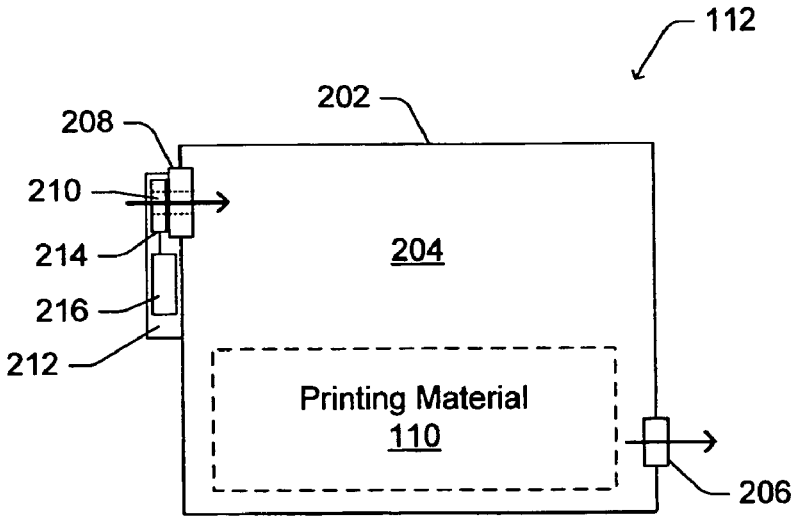
FIG. 2 is a block diagram depicting an exemplary container having a fill indicator, in accordance with certain embodiments of the present invention.

Reference is now made to FIG. 2, which illustrates, in more detail, certain exemplary features of a representative container 112 depicted in block diagram form.

As shown, container 112 includes a housing 202 forming a reservoir 204 therein for holding printing material 110. Reservoir 204 may include other materials or structures therein as needed. For example, bags, bladders, foam or other wicking material may be provided for fluid retention and other purposes as is known in the art for inkjet printing, and compartments, stirring mechanisms, etc., as is known in the art may be provided for toner stirring/movement in laser printing. As is also known in the art, container 112 may be incorporated into or otherwise include a printhead mechanism (not shown) in certain implementations.

Housing 202 includes an outlet feature (e.g., an outlet port 206) that is configured to allow printing material 110 to be withdrawn or otherwise accessed from within reservoir 204 in support of a printing process. Housing 202 also includes an inlet feature (e.g., a fill port 208) that is configured to allow printing material 110 to be deposited or otherwise placed into reservoir 204.

Outlet port 206 and fill port 208 may come in a variety of different shapes, forms and include various mechanisms to perform or otherwise support the printing, servicing and/or filling processes depending upon the type of printing device 102 and/or printing material 110. For example, for an inkjet printer fill port 208 may be mechanically configured to keep fluid from inadvertently leaking out of reservoir 204 by providing a self-sealing mechanism (not shown), e.g., a septum or other like feature that allows a needle or other implementation to momentarily enter reservoir 204 and introduce additional (or possibly different) printing material 110 therein.

For a laser printer, fill port 208 may be mechanically configured to keep toner from inadvertently leaking out of reservoir 204. For example, fill port 208 may include a sealable mechanism (not shown), e.g., a small hatch or door that latches or automatically closes, or other like feature that allows introduction of additional (or possibly different) printing material 110 into reservoir 204 therethrough.

These are just a few examples; those skilled in the art will recognize that a variety of well known mechanical features may be used. Regardless of the mechanism(s) used for fill port 208, there will be at least momentarily an opening 210 within fill port 208 during a fill process.

Container 112 further includes a fill indicator 212 that is configured to be detectably altered as a result of a fill process that utilizes fill port 208. Thus, for example, in certain exemplary implementations, a breach mechanism 214 of fill indicator 212 is permanently altered when opening 210 is created or otherwise used for the first time to fill reservoir 204. The resulting alteration of breach mechanism 214 changes, in some manner, at least one detectable electrical characteristic of breach mechanism 214. By way of example, a fill instrument or tool, such as for example, a needle (not shown) would alter breach mechanism 214 before passing through opening 210. In certain implementations, such alteration is permanent.

For example, the detectable electrical characteristic may include a resistive characteristic, a capacitive characteristic, an inductive characteristic, or combination thereof that is associated with breach mechanism 214. As such, the electrical characteristic would exhibit an initial state prior to alteration and a different state following alteration. Accordingly, a determination can then be made by corresponding or other circuitry upon detection of the electrical characteristic as to whether fill port 208 has or has not been used during a fill process.

To detect the electrical characteristic of the breach mechanism 214 of fill indicator 212, an interface 216 may be provided. Interface 216 may include one or more conducting features, such as, e.g., wires, paths, contacts, terminals, antennas, or the like, that allow circuitry 122 and/or 124 to electrically detect the electrical characteristic of breach mechanism 214. As previously described in certain implementations, interface 216 may include all or part of circuitry 122.

Figure 3A:
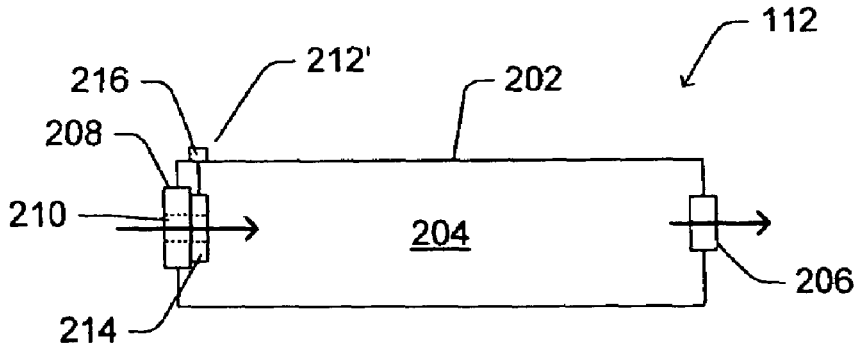
FIGS. 3A-C are illustrative diagrams depicting different exemplary containers having fill indicators, in accordance with certain embodiments of the present invention.
Figure 3B:
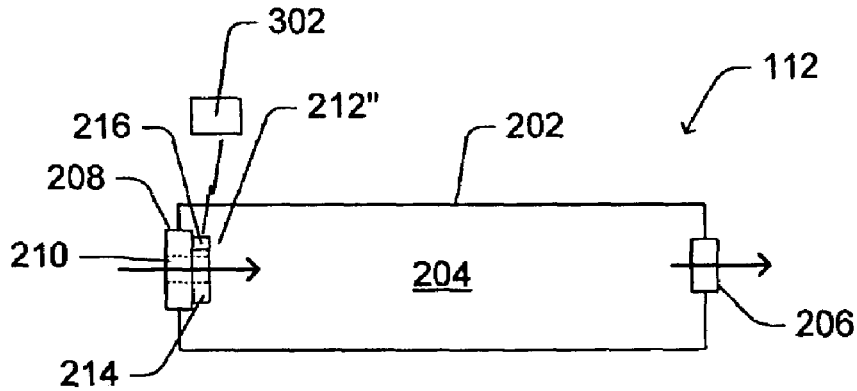
Figure 3C:
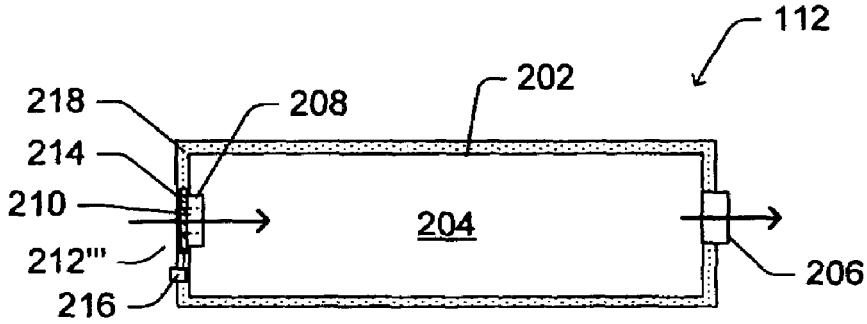

Attention is drawn to FIGS. 3A-C, which illustrate some exemplary alternative arrangements of a fill indicator of container 112.

In FIG. 3A, fill indicator 212' includes an interface 216 that is arranged on a different side of container 112 than fill port 208 and a breach mechanism 214 that is at least partially within reservoir 204. Here, for example, during a fill process a needle (not shown) would alter breach mechanism 214 after passing through opening 210.

In FIG. 3B, fill indicator 212" includes a wireless interface 216 that is arranged to communicate with a corresponding wireless portion 302. Wireless portion 302 may be part of circuitry 122 or 124, for example. Wireless interface 216 may include active or passive wireless components. For example, wireless interface 216 may include a transponder, radio frequency identification (RFID) device or the like, an antenna, or other remotely detectable circuitry capable of identifying if breach mechanism 214 has or has not been altered. While illustrated in this example as being within reservoir 204, it is recognized that wireless interface 216 may be all or partially arranged outside reservoir 204.

Wireless portion 302 may be configured to transmit an interrogation signal or the like that causes wireless interface 216 to respond in some manner indicative of the state or condition of breach mechanism 214. Thus, for example, in certain implementations, when breach mechanism 214 has not been altered wireless interface 216 may be able to respond in turn by transmitting or reflecting a return signal. However, when breach mechanism 214 has been altered wireless interface 216 may be prevented from responding with such a return signal. In certain other implementations, this process may be opposite such that until breach mechanism 214 has been altered wireless interface 216 is unable to respond in turn by transmitting or reflecting a return signal.

While the above examples refer to transmitting electromagnetic signals, in other certain implementations wireless interface 216 and wireless portion 302 may employ magnetic, inductive and/or capacitive "wireless" coupling that essentially performs the function of indicating to circuitry 122 and/or 124 if breach mechanism 214 has or has not been altered as a likely result of container 112 being filled with printing material 110.

FIG. 3C illustrates that in certain implementations, fill indicator 212'" may be formed at least partially within the structure of housing 202. Here, for example, breach mechanism 214 is arranged within a wall 218 of housing 202 and at least a portion of interface 216 is accessible outside of housing 202. If interface 216 were wireless, then it too may be arranged within wall 218.

Those skilled in the art will recognize that other arrangements are possible for providing a fill indicator of a container.

Reference is now made to FIGS. 4A-E, which illustrate an exemplary breach mechanism 400 before and after being altered during a fill process.

Figure 4A:
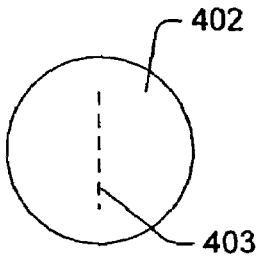
FIGS. 4A-E are illustrative diagrams depicting an exemplary breach mechanism of an exemplary fill indicator prior to and following a filling process, in accordance with certain embodiments of the present invention.

FIG. 4A shows a fill port 402 that is configured to receive a fill needle by opening at a slit opening 403 when the needle is inserted and resiliently closing once the needle is withdrawn. Fill port 402 may be configured of a pliable rubber, plastic or other like material, for example. Such ports and others are well known in the art.

Figure 4B:
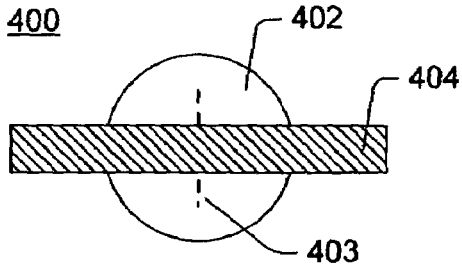

FIG. 4B illustrates a breach mechanism 400 using the fill port of FIG. 4A. Here, an electrically conductive member 404 is arranged over at least a portion of fill port 402 and in particular over at least a part of slit opening 403. Electrically conductive member 404 is capable of conducting electricity in this unaltered condition and may include, for example, one or more wires, traces, material layers, etc. Thus, electrically conductive member 404 exhibits an initial electrical characteristic that is detectable or determinable electrically by circuitry 122 and/or 124.

Figure 4C:
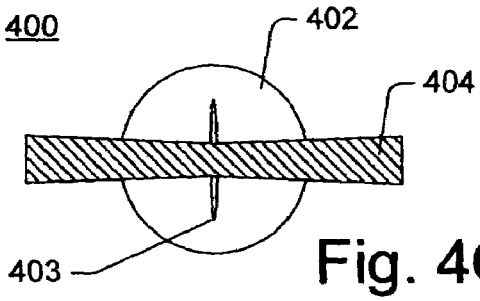

FIG. 4C illustrates breach mechanism 400 during the insertion of a needle through fill port 402. As shown in this example, slit opening 403 begins to open as the needle is forced through it, adding pressure as stress or tension to member 404. For demonstrative purposes in FIG. 4C, member 404 is illustrated as stretching/narrowing as a result of this pressure. It should be understood, however, that this is just an illustration and that in other examples member 404 may be more brittle or exhibit other responses to such pressure.

Figure 4D:
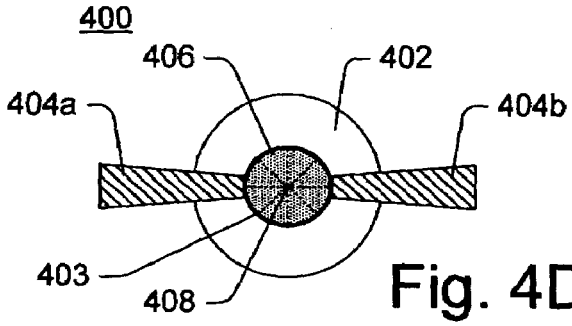

FIG. 4D illustrates breach mechanism 400 after needle 406 has passed through fill port 402 and member 404. Here, needle 406 includes a channel 408 through which printing material 110 may be introduced into reservoir 204. As shown in this example, slit opening 403 has opened for needle 406 and during needle insertion member 404 has separated into two portions, namely first member portion 404*a* and second member portion 404*b*.

Figure 4E:
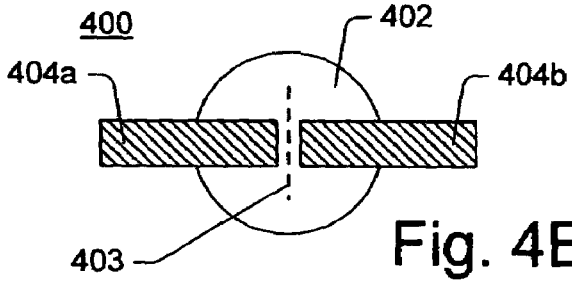

FIG. 4E illustrates breach mechanism 400 after needle 406 has been subsequently removed from fill port 402. As shown in this example, slit opening 403 has closed and is sealed. Member 404 remains separated into first member portion 404*a* and second member portion 404*b*. In this condition, as illustrated, first member portion 404*a* is electrically isolated from second member portion 404*b*. Consequently, electrically conductive member 404 now exhibits an altered electrical characteristic that is detectable or determinable electrically by circuitry 122 and/or 124.

While fill port 402 and member 404 are illustrated in these examples as being separate, in certain other implementations they may be integrally formed such that once the fill port has been used it exhibits at least one different detectable electrical characteristic.

Reference is now made to FIGS. 5A-D, which illustrate another exemplary breach mechanism 500 before and after being altered during a fill process.

Figure 5A:
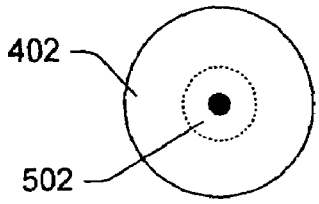
FIGS. 5A-D are illustrative diagrams depicting another exemplary breach mechanism of an exemplary fill indicator prior to and following a filling process, in accordance with certain other embodiments of the present invention.

FIG. 5A shows a fill port 402 that is configured to receive a fill needle by opening at a sealing hole opening 503 when the needle is inserted and resiliently closing once the needle is withdrawn. Fill port 402 may be configured of a pliable rubber, plastic or other like material, for example.

Figure 5B:
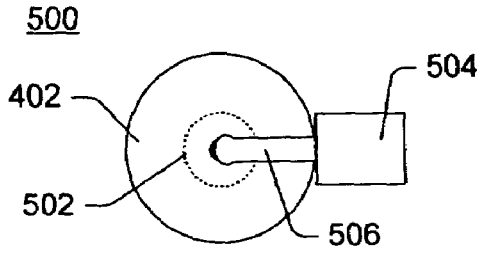

FIG. 5B illustrates a breach mechanism 500 using the fill port of FIG. 5A. Here, an electrically conductive member 504 is arranged over at least a portion of fill port 402 and in particular near hole opening 503. In this example, electrically conductive member 504 includes an alterable portion 506 that is acted upon and thereby altered in some manner during the fill process to cause a change in at least one detectable electrical characteristic of member 504. Thus, electrically conductive member 504 exhibits an initial electrical characteristic that is detectable or determinable electrically by circuitry 122 and/or 124. By way of further example, in certain implementations member 504 may include a switching mechanism that makes or breaks electrical contacts, or in some other manner records or identifies that a fill process has occurred.

While FIGS. 5A-D depict a mechanically activated switch, in other implementations such switching mechanism may or may not employ mechanically changing structures typically associated with switches. For example, a solid state switch mechanism may be employed. In other implementations, one or more layers of conductive material(s) or other types of materials may be punctured or otherwise altered in a fashion that increases or decreases a detectable electrical characteristic of member 504.

Figure 5C:
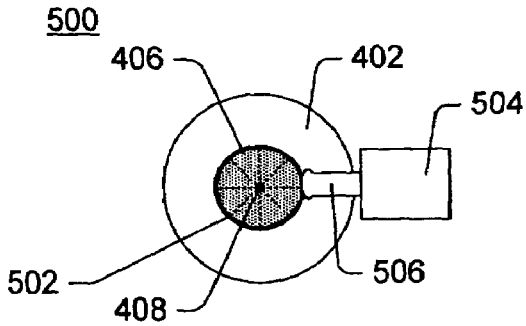

FIG. 5C illustrates breach mechanism 500 after needle 406 has passed through fill port 402 and affected alterable portion 506 and member 504. As shown in this example, hole opening 503 has opened for needle 406 and during needle insertion alterable portion 506 has been moved or otherwise acted upon through contact with needle 406.

Figure 5D:
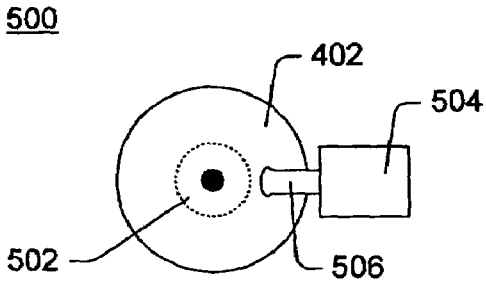

FIG. 5D illustrates breach mechanism 500 after needle 406 has been subsequently removed from fill port 402. As shown in this example, hole opening 503 has closed and is sealed. Member 504 remains altered as illustrated by alterable portion 506 being in a different position than that illustrated in FIG. 5B. In this resulting position/condition, electrically conductive member 504 now exhibits a different electrical characteristic that is detectable or determinable electrically by circuitry 122 and/or 124.

FIGS. 6A-D illustrate an exemplary breach mechanism 600 before and after being altered during a fill process as may be implemented for a container that holds toner.

Figure 6A:
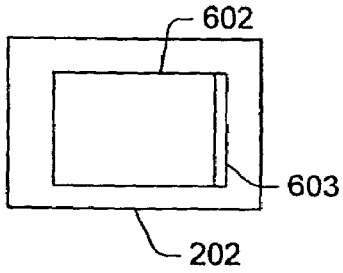
FIGS. 6A-D are illustrative diagrams depicting still another exemplary breach mechanism within an exemplary fill indicator prior to and following a filling process, in accordance with certain further embodiments of the present invention.

FIG. 6A shows a fill port 602 formed in housing 202 that is configured to moveably open at a hinged portion 603 or other like feature.

Figure 6B:
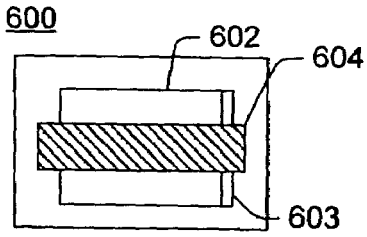

FIG. 6B illustrates a breach mechanism 600 using the fill port of FIG. 6A. Here, an electrically conductive member 604 is arranged over at least a portion of fill port 602. Electrically conductive member 604 is capable of conducting electricity in this unaltered condition and may include, for example, one or more wires, traces, material layers, etc. Thus, electrically conductive member 604 exhibits an initial electrical characteristic that is detectable or determinable electrically by circuitry 122 and/or 124.

Figure 6C:
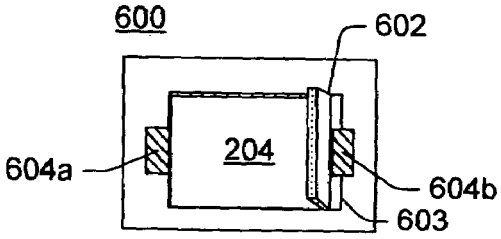

FIG. 6C illustrates breach mechanism 600 when open to allow printing material 110 to be added to reservoir 204. Here, fill port 602 has swung open on hinged portion 603 to reveal reservoir 204. Note that in the FIG. 6C, fill port 602 is illustrated as a door or hatch that is swung upwardly. As shown in this example, the opening of fill port 602 has separated member 604 into two portions, namely first member portion 604*a* and second member portion 604*b*.

Figure 6D:
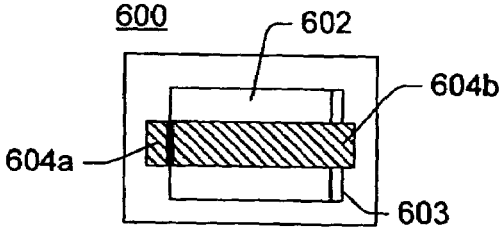

FIG. 6D illustrates breach mechanism 600 when subsequently closed. Member 604 remains separated into first member portion 604*a* and second member portion 604*b*. In this condition, as illustrated, first member portion 604*a* is electrically isolated from second member portion 604*b*. Consequently, electrically conductive member 604 now exhibits an altered electrical characteristic that is detectable or determinable electrically by circuitry 122 and/or 124.

While fill port 602 and member 604 are illustrated in these examples as being separate, in certain other implementations they may be integrally formed such that once the fill port has been used it exhibits at least one different detectable electrical characteristic.

FIGS. 7A-D illustrate yet another exemplary breach mechanism 700 before and after being altered during a fill process.

Figure 7A:
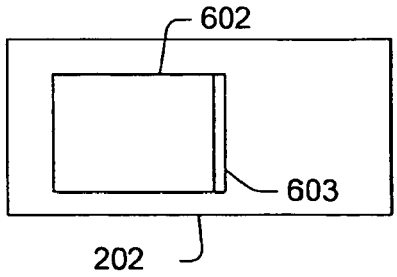
FIGS. 7A-D are illustrative diagrams depicting yet another exemplary breach mechanism of an exemplary fill indicator prior to and following a filling process, in accordance with certain embodiments of the present invention.

FIG. 7A shows a fill port 602 formed in housing 202 that is configured to moveably open at a hinged portion 603 or other like feature.

Figure 7B:
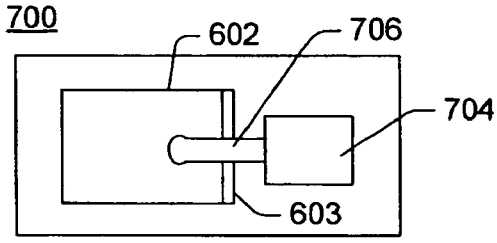

FIG. 7B illustrates a breach mechanism 700 using the fill port of FIG. 7A. Here, an electrically conductive member 704 is arranged over at least a portion of fill port 602. In this example, electrically conductive member 704 includes an alterable portion 706 that is acted upon and thereby altered in some manner during the fill process to cause a change in at least one detectable electrical characteristic of member 704. Thus, electrically conductive member 704 exhibits an initial electrical characteristic that is detectable or determinable electrically by circuitry 122 and/or 124. By way of further example, in certain implementations member 704 may include a switching mechanism that makes or breaks electrical contacts, or in some other manner records or identifies that a fill process has occurred.

Figure 7C:
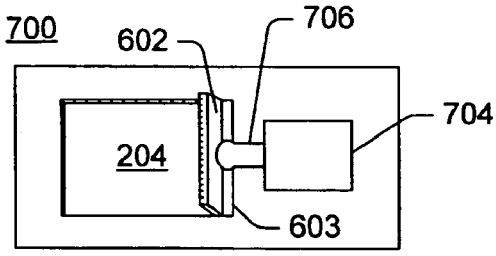

FIG. 7C illustrates breach mechanism 700 when fill port 602 is open to allow printing material 110 to be added to reservoir 204. Here, fill port 602 has swung open on hinged portion 603 to reveal reservoir 204. Note that in the FIG. 7C, fill port 602 is illustrated as a door or hatch that is swung upwardly The opening of fill port 602 has caused alterable portion 706 in some manner.

Figure 7D:
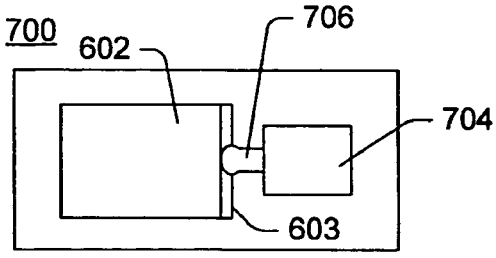

FIG. 7D illustrates breach mechanism 700 after fill port is subsequently closed. Member 704 remains altered as illustrated by alterable portion 706 being in a different position than that illustrated in FIG. 7B. In this resulting position/condition, electrically conductive member 704 now exhibits a different electrical characteristic that is detectable or determinable electrically by circuitry 122 and/or 124.

Associated with the above exemplary implementations is a method that includes forming container 112 configured to receive printing material 110 through fill port 208, hold printing material 110 in reservoir 204, and dispense printing material 110 through outlet port 206. This method includes providing an initial amount of printing material 110 within container 112, and operatively coupling a fill indicator 212 to container 112. Here, for example, fill indicator 212 may include breach mechanism 214, which is configured to be detectibly altered when fill port 208 is used to deposit printing material 110 into reservoir 204. Interface 216, which is operatively coupled to breach mechanism 214, is configured to allow detection of at least one electrical characteristic of breach mechanism 216.

By way of example, the electrical characteristic may include an electrical resistive characteristic, an electrical capacitive characteristic, an electrical inductive characteristic, or the like.

Another exemplary method associated with the above exemplary implementations includes filling container 112 with an amount of printing material 110 through fill port 208 in a manner that detectably alters fill indicator 212. The method may further include operatively coupling container 112 to a printing device 102, detecting at least one electrical characteristic of breach mechanism 214 using interface 216, and determining that container 112 has been filled through fill port 208 based on the detected electrical characteristic. The method may also include, upon determining that container 112 has been filled through fill port 208, identifying through at least one user interface 118, 126 that container 112 has been determined to have been filled.

Although the above disclosure has been described in language specific to structural/functional features and/or methodological acts, it is to be understood that the appended claims are not limited to the specific features or acts described. Rather, the specific features and acts are exemplary forms of implementing this disclosure.

What is claimed is:

1. An apparatus for use in a printing device, the apparatus comprising:

a housing forming a reservoir that is suitable for holding a printing material therein, and having an outlet feature through which said printing material may be withdrawn from said reservoir and an inlet feature through which an amount of said printing material may be deposited within said reservoir; and a fill indicator operatively coupled to said housing, said fill indicator comprising:

a breach mechanism located near said inlet feature and disposed with respect to said inlet feature such that said breach mechanism is detectibly altered when said inlet feature is opened, and an interface operatively coupled to said breach mechanism and configured to allow detection of at least one electrical characteristic of said breach mechanism.

2. The apparatus as recited in claim 1, wherein said electrical characteristic is in a first state prior to said breach mechanism being altered and is in a second state that is different than the first state once said breach mechanism is altered.

3. The apparatus as recited in claim 1, wherein said electrical characteristic is selected from a group of electrical properties comprising an electrical resistive characteristic, an electrical capacitive characteristic, and an electrical inductive characteristic.

4. The apparatus as recited in claim 1, wherein said interface is configurable to allow detection of said electrical characteristic by circuitry that is external to the apparatus.

5. The apparatus as recited in claim 1, wherein said interface includes circuitry operatively coupled to said breach mechanism configured to allow detection of said electrical characteristic.

6. The apparatus as recited in claim 5, wherein said circuitry is configured to output at least one signal relating to said electrical characteristic.

7. The apparatus as recited in claim 1, wherein at least a portion of said breach mechanism extends across at least a portion of an opening of said inlet feature.

8. The apparatus as recited in claim 7, wherein said portion of said breach mechanism covers said opening of said inlet feature.

9. The apparatus as recited in claim 7, wherein said portion of said breach mechanism is arranged in at least one of the following ways:

(1) on said housing external said reservoir, (2) on said housing within said reservoir, or (3) within said housing.

10. The apparatus as recited in claim 7, wherein said portion of said breach mechanism includes at least one electrically conductive member.

11. The apparatus as recited in claim 10, wherein said breach mechanism is disposed with respect to said inlet feature such that said electrically conductive member is severed into at least two electrically isolated portions when said inlet feature is opened.

12. The apparatus as recited in claim 10, wherein said portion of said breach mechanism further includes at least one additional electrically conductive member and said breach mechanism is disposed with respect to said inlet feature such that said additional electrically conductive member contacts said electrically conductive member when said inlet feature is opened.

13. The apparatus as recited in claim 1, wherein said printing material includes at least one printing material selected from a group of printing materials comprising an ink and a toner.

14. The apparatus as recited in claim 1, wherein said interface is a wireless interface.

15. The apparatus as recited in claim 1, wherein said breach mechanism is permanently detectibly altered when said inlet feature is opened.

16. The apparatus as recited in claim 2, wherein said breach mechanism is disposed with respect to the inlet feature such that the breach mechanism is physically altered when said inlet feature is opened and said electrical characteristic changes from said first state to said second state when said breach mechanism is physically altered.

17. A method comprising:

forming a container configured to receive a printing material through a fill port, hold said printing material, and dispense said printing material through an outlet port;

providing an initial amount of said printing material within said container; and operatively coupling a fill indicator to said container, said fill indicator comprising a breach mechanism located near said fill port and disposed with respect to said fill port such that said breach mechanism is detectibly altered when said fill port is opened to deposit an additional amount of said printing material into said reservoir, and an interface operatively coupled to said breach mechanism and configured to allow detection of at least one electrical characteristic of said breach mechanism.

18. The method as recited in claim 17, wherein said electrical characteristic is selected from a group of electrical properties comprising an electrical resistive characteristic, an electrical capacitive characteristic, and an electrical inductive characteristic.

19. The method as recited in claim 17, wherein operatively coupling said fill indicator to said container includes configuring at least a portion of said breach mechanism to extend across at least a portion of an opening of said fill port.

20. The method as recited in claim 19, wherein operatively coupling said fill indicator to said container includes configuring said portion of said breach mechanism to cover said opening of said fill port.

21. The method as recited in claim 17, wherein said printing material includes at least one printing material selected from a group of printing materials comprising an ink and a toner.

22. The method as recited in claim 17, wherein said breach mechanism is permanently detectibly altered when said fill port is opened to deposit said additional amount of said printing material into said reservoir.

23. A method comprising:

providing a container configured to receive a printing material through a fill port, hold said printing material, and dispense said printing material through an outlet port; and filling said container with an amount of printing material through said fill port to detectably alter a fill indicator associated with said fill port, said fill indicator comprising a breach mechanism located near said fill port and disposed with respect to said fill port such that said breach mechanism is detectibly altered when said fill port is opened, and an interface operatively coupled to said breach mechanism and configured to allow detection of at least one electrical characteristic of said breach mechanism.

24. The method as recited in claim 23, wherein said electrical characteristic is selected from a group of electrical properties comprising an electrical resistive characteristic, an electrical capacitive characteristic, and an electrical inductive characteristic.

25. The method as recited in claim 23, further comprising:

operatively coupling said container to a printing device;

detecting said electrical characteristic of said breach mechanism using said interface, and determining that said container has been filled through said fill port based on said detected electrical characteristic.

26. The method as recited in claim 25, further comprising:

upon determining that said container has been filled through said fill port, identifying through at least one user interface that said container has been determined to have been filled with said amount of said printing material.

27. The method as recited in claim 23, wherein said printing material includes at least one printing material selected from a group of printing materials comprising an ink and a toner.

28. The method as recited in claim 23, wherein said breach mechanism is permanently detectibly altered when said fill port is opened.

29. A printing device comprising:

a receptacle for receiving a container, said container comprising a fill port and a fill indicator having a breach mechanism located near said fill port and disposed with respect to said fill port such that said breach mechanism is detectibly altered when said fill port is opened to introduce a printing material into said container, and an interface operatively coupled to said breach mechanism and configured to allow detection of at least one electrical characteristic of said breach mechanism; and circuitry configured to operatively couple to said interface, detect said electrical characteristic, determine if said fill port has been opened based on said detected electrical characteristic, and output at least one signal corresponding to said determination.

30. The printing device as recited in claim 29, further comprising:

a user interface operatively coupled to said circuitry and configured to identify a condition of said container based on said output signal corresponding to said determination.

31. The printing device as recited in claim 29, wherein said circuitry wirelessly operatively couples to said interface.

32. The printing device as recited in claim 29, wherein said breach mechanism is permanently detectibly altered when said fill port is opened to introduce said printing material into said container.

33. An apparatus comprising:

means for holding a printing material;

means for allowing access to said means for holding said printing material such that said printing material can be added; and means located near said means for allowing for indicating that said means for allowing access to said means for holding said printing material has been opened to add said printing material.

34. The apparatus as recited in claim 33, further comprising:

means for interfacing with said means for indicating.

* * * * *